United States Patent [19]

Narveson et al.

[11] 4,386,345

[45] May 31, 1983

[54] COLOR AND BRIGHTNESS TRACKING IN A CATHODE RAY TUBE DISPLAY SYSTEM

[75] Inventors: Parm L. Narveson; Robert W. Clark; Lawrence C. Hannert, all of Phoenix, Ariz.

[73] Assignee: Sperry Corporation, New York, N.Y.

[21] Appl. No.: 304,451

[22] Filed: Sep. 22, 1981

[51] Int. Cl.[3] ..... G09G 1/00; G09G 1/28

[52] U.S. Cl. ..... 340/703; 340/732; 340/721; 340/745; 340/742; 358/29; 364/514

[58] Field of Search ..... 340/793, 742, 701, 703, 340/720, 732, 721, 723, 745, 736, 744, 748, 749, 750, 705, 27 NA, 27 AT; 358/22, 27, 29; 364/515

[56] References Cited

U.S. PATENT DOCUMENTS

| | | | |
|---|---|---|---|
| 3,200,193 | 8/1965 | Biggs et al. | 358/29 |
| 3,527,980 | 9/1970 | Robichaud et al. | 340/793 |
| 4,206,457 | 6/1980 | Weisbecker et al. | 340/703 |
| 4,225,861 | 9/1980 | Langdon, Jr. et al. | 340/701 |
| 4,240,073 | 12/1980 | Seats et al. | 340/720 |
| 4,346,399 | 8/1982 | Akutagawa et al. | 358/29 |

*Primary Examiner*—Marshall M. Curtis

*Attorney, Agent, or Firm*—Howard P. Terry; Albert B. Cooper

[57] ABSTRACT

A color cathode ray tube display apparatus particularly for use under a wide range of ambient light conditions, such as in an aircraft cockpit, wherein each of the primary color phosphors has a unique brightness versus cathode drive characteristic, which characteristic also is dependent upon whether the displayed information is raster written or stroke written and wherein such characteristics also may vary from tube to tube. The output of at least one cockpit ambient light sensor in addition to a pilot selected brightness is used on a continuous basis to calculate a reference brightness level for the sensed ambient brightness conditions and display writing mode, this reference brightness level being used to calculate the corresponding brightness level for each of the primary color components of the commanded symbology color and concomitant drive voltages to the CRT's cathode or cathodes. The operation and ambient brightness calculations are preferably performed by a microprocessor and associated personality PROM containing the color/brightness characteristics of the particular cathode ray tube to which it is dedicated. The computations used are preferably logarithmic as is the data whereby not only to simplify calculations but more importantly to correspond to the normal logarithmic reception characteristics of the human eye.

12 Claims, 6 Drawing Figures

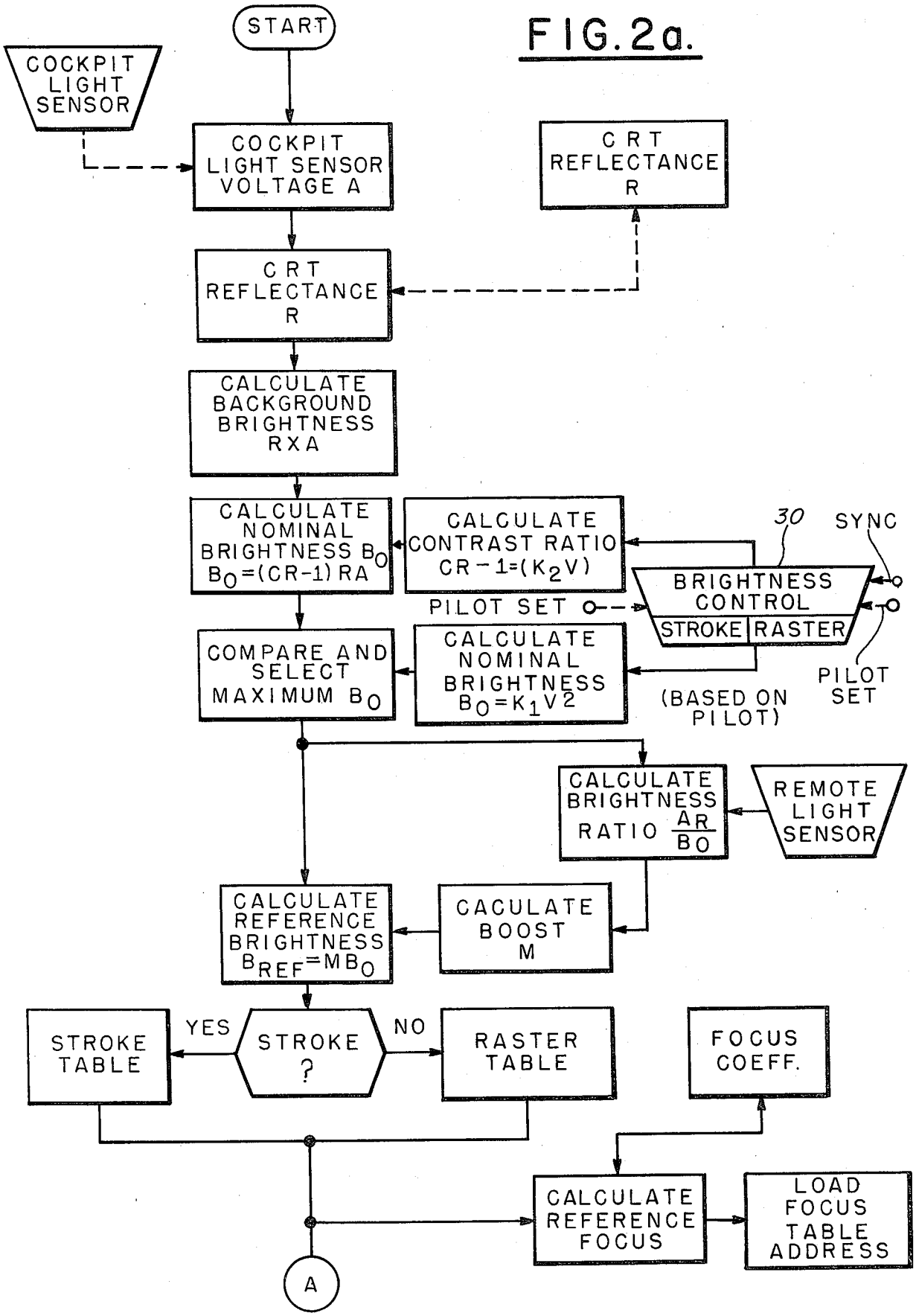
FIG. 2a.
START
COCKPIT LIGHT SENSOR
COCKPIT LIGHT SENSOR VOLTAGE A
CRT REFLECTANCE R
CRT REFLECTANCE R
CALCULATE BACKGROUND BRIGHTNESS RXA
CALCULATE NOMINAL BRIGHTNESS $B_O$ $B_O=(CR-1)RA$
CALCULATE CONTRAST RATIO $CR-1=(K_2V)$
30
SYNC
BRIGHTNESS CONTROL
STROKE
RASTER
PILOT SET
PILOT SET
(BASED ON PILOT)
COMPARE AND SELECT MAXIMUM $B_O$
CALCULATE NOMINAL BRIGHTNESS $B_O=K_1V^2$
CALCULATE BRIGHTNESS RATIO $\frac{AR}{B_O}$
REMOTE LIGHT SENSOR
CALCULATE REFERENCE BRIGHTNESS $B_{REF}=MB_O$
CACULATE BOOST M
STROKE TABLE
YES
STROKE ?
NO
RASTER TABLE
FOCUS COEFF.
CALCULATE REFERENCE FOCUS
LOAD FOCUS TABLE ADDRESS
A

COLOR AND BRIGHTNESS TRACKING IN A CATHODE RAY TUBE DISPLAY SYSTEM

BACKGROUND OF THE INVENTION

1. Field of the Invention

The present invention relates generally to color cathode ray tube (CRT) display apparatus and more particularly to CRT displays used in applications under which the ambient light conditions vary over a very wide range. One such application is an aircraft cockpit wherein the ambient light can vary from direct, high altitude sunlight to almost total darkness. High contrast enhancement filter techniques of the type disclosed in the present assignee's U.S. Pat. No. 3,946,267 are used to maintain the desired contrast ratios under such light ambients. More specifically, the present invention relates to CRT display apparatus; for example a shadow-mask type color CRT, for use in such ambient light conditions which automatically and independently adjusts the cathode drive voltage of the cathode for each of the color phosphors dependent upon each of the phosphor's light emissive characteristic at a variable reference brightness and in accordance with the display writing technique being used, i.e., raster or stroke. In addition, the apparatus of the invention may include a provision for providing a reference focus of the cathode beam for ecah color in accordance with the reference brightness.

2. Description of the Prior Art

In most prior art CRT display systems, such as for example, home and commercial TV's, where normal viewing ambient light conditions do not vary significantly or where if viewing is in high ambient light conditions mechanical shadesor baffles are used to prevent direct sunlight from impinging upon the CRT face, essentially fixed predetermined drive voltages for the green, red and blue cathodes are used. Thus, any changes in the manual brightness setting causes only a d.c. shift in the voltages applied to the CRT. To restore the proper colors, readjustment of the green, red, and blue guns is necessary. Since the adjustments are over a relatively narrow range of ambient light conditions, the color shift is slight and generally ignored. The automatic brightness function on commercial TV's affects the drive of all three guns in identically the same manner and has no features to compensate for color shifts; but again the small operating envelope keeps the error from being objectionable.

Thus, known conventional color CRT brightness controls, whether automatic, manual or both are unsuitable for use in color CRT's used to display information in an aircraft cockpit environment.

SUMMARY OF THE INVENTION

A color cathode ray tube display apparatus of the shadow-mask type or other type of multiple color tube, such as the beam index tube, particularly adapted for use in an aircraft instrument panel, for example, an electronic flight instrument, where the display face and the pilot's eyes are subjected to a very wide range of ambient light from direct sunlight (e.g., $10^{+4}$ foot candles) to substantially total darkness (e.g., $10^{-2}$ foot candles), preferably includes a dedicated digital microprocessor and associated RAM's and PROM's which, among other CRT related functions, independently controls or sets, preferably at a rate no less than the display refresh rate, the brightness of each of the primary colors in accordance with the ambient light conditions, not only within the cockpit but also the light intensity external to the cockpit and to which the pilot's eyes are subjected when he is looking out of the windows. The microprocessor also controls the CRT's brightness setting in accordance with the specific characteristics peculiar to the particular CRT with which it is associated; e.g., its specific phosphor emittance and the CRT face reflectance characteristics. Thus, the display brightness and contrast relative to the cockpit ambient brightness is maintained substantially constant over the entire ambient light intensity spectrum to which it and the pilot's eyes are subjected. Additionally, in color CRT displays which are capable of displaying information using both raster and stroke writing techniques, the color brightness and contrast vary significantly dependent upon which writing technique is being used. The microprocessor of the present invention recognizes these differences and adjusts each color intensity accordingly. While the invention is preferably implemented using a dedicated digital microprocessor and associated memories, it will be recognized by those skilled in the CRT display are that discrete digital circuit technique and analog circuit techniques may also be employed to accomplish the color brightness tracking of the display over the entire ambient light intensity range. A further advantage of the invention is that the display CRT is driven no harder than necessary thereby maximizing the overall life of the CRT.

BRIEF DESCRIPTION OF THE DRAWINGS

A preferred embodiment of the present invention is illustrated in the attached drawings wherein:

FIGS. 2*a* and 2*b* comprises a flow chart illustrating the microprocessor color and brightness control program stored in the controller memory;

DESCRIPTION OF THE PREFERRED EMBODIMENT

A typical electronic flight instrument system for an aircraft usually comprises two basic units; a display unit mounted in the aircraft cockpit and a symbol generator unit normally mounted in the aircraft's electronics bay, the former displaying the flight control, flight navigation, and annunciation or status information generated by the symbol generator. Multiple identical display units may be employed each displaying the desired flight data, such as a primary flight display (attitude, flight director, etc.) and a navigation display (map, weather radar, etc.) which may be driven by a single symbol generator. Multiple display units (pilot's and copilot's instruments) may also be driven by dual symbol generators, suitable switching control panels being provided for any desired manual and/or automatic cross switching between symbol generators and display units. Actually, the invention is applicable to any color CRT subjected to wide ranges of ambient light conditions. The display unit of such an overall system is the subject of the present invention. More specifically, since each of the display units is subject to a very wide range of ambient light conditions and since the units are located at different positions in the aircraft panel or cockpit and are therefore subject to different ambient light conditions within the overall cockpit ambient, the apparatus of the present invention automatically adapts the pilot's selected brightness of each display unit to such conditions.

Figure 1:
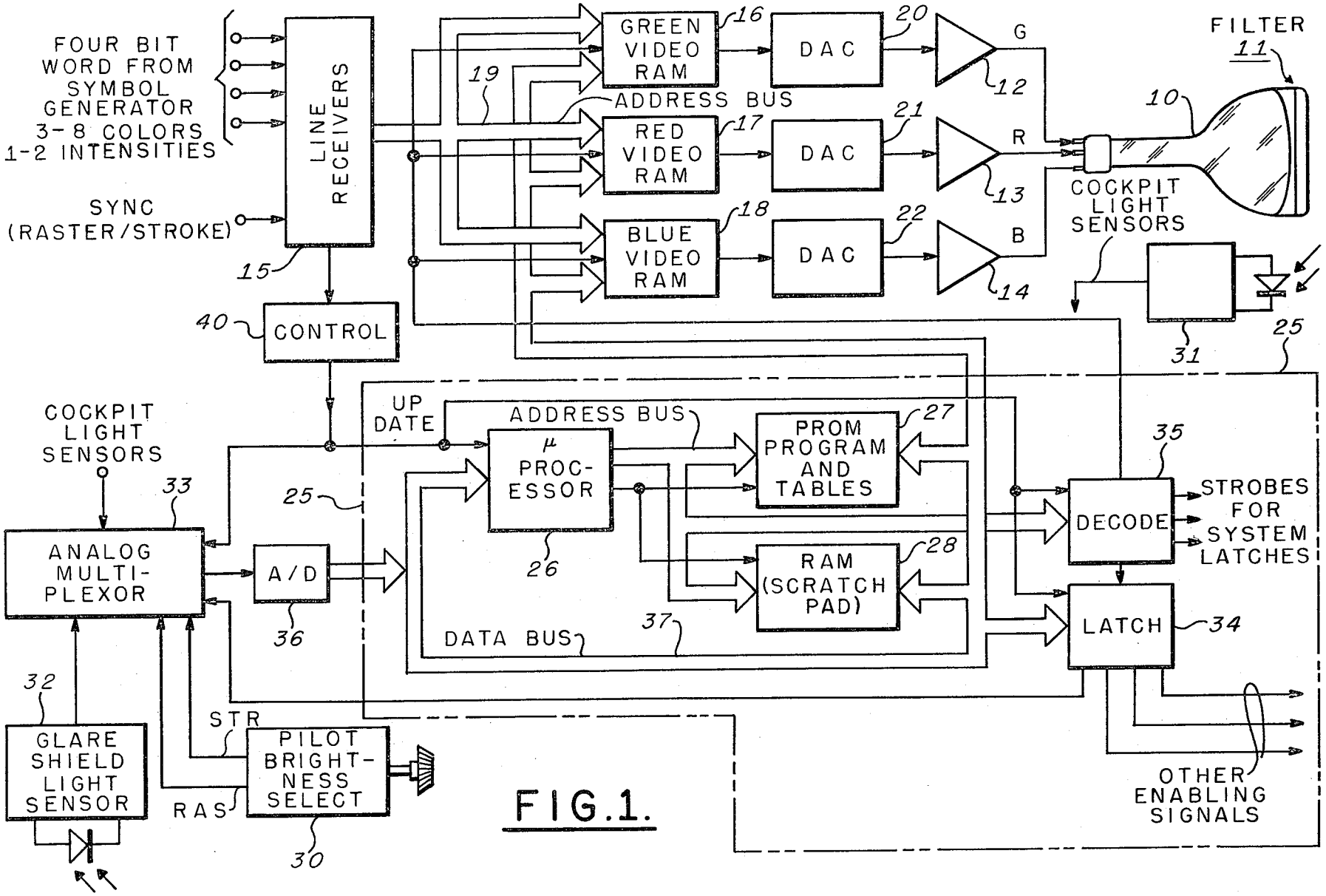
FIG. 1 is a block diagram of that portion of a CRT display unit pertinent to the present invention and illustrating the digital microprocessor controller dedicated to the operation of the CRT.

FIG. 1 illustrates those portions of the display unit pertinent to the color brightness tracking apparatus of the present invention. In general, the display unit comprises a conventional shadow-mask color CRT 10 having a contrast enhancement filter 11, which may be of the type disclosed in the above U.S. Pat. No. 3,946,267, bonded to its faceplate, such as in the manner taught in Applicant's assignee's U.S. Pat. No. 4,191,725. It will be appreciated that in the interest of clarity and brevity unrelated but necessary CRT apparatus such as deflection coils and their associated electronics, focus controls, convergence assembly and controls, power supplies and the like having been omitted. It should be noted however, that the present invention is applicable to other types of color CRT's such as beam index tubes. Conventionally, the shadow-mask CRT includes green, red and blue cathodes, not shown, for emitting the three electron beams which excite the corresponding green, red and blue phosphor triads through the screen apertures, the filtered output light intensity of each phosphor, in foot lamberts, varying in accordance with the voltage applied to each cathode in a determinable manner, such ratio being referred to as the gamma ($\gamma$) for each primary color and which may vary from tube to tube. The green, red and blue cathode drive voltages are supplied from corresponding video amplifiers 12, 13 and 14, respectively.

The basic video drive command is supplied from the symbol generator, not shown, through a conventional line receiver 15 synchronized with the refresh rate of the symbol generator. A typical format for the video command from the symbol generator is a four bit digital word which can provide for eight different colors (including video blanking as black) and two diffeent commanded intensities per color. Alternatively, the fourth bit may be used to substantially double the number of different colors which may be commanded. The video command is used to address green, red and blue video RAMs 16, 17 and 18 via address bus 19, the operation of which will be discussed in detail below, the digital RAM outputs being converted to analog green, red and blue cathode drive voltages through conventional DAC's 20, 21 and 22 to produce the desired or commanded color and intensity of the symbols drawn on the tube face by the deflection system.

It should be pointed out here that the present invention is applicable to display systems wherein the symbol generator drives two or more separate display units or only one display unit. It is also applicable to display systems involving one or more displays which are all raster written or all stroke written or both raster and stroke written. In the dual, raster and stroke written display unit system, it is convenient to control system timing such that when one display unit is being raster written, the other is being stroke written. When a single display unit is being used raster and stroke writing may be used alternately, e.g., stroke write during raster flyback. Thus, the synch signal illustrated in FIG. 1 may be a stroke/raster command signal as will be further described below.

In accordance with the teachings of the present invention, the display unit includes a display unit controller 25 which in turn includes its own dedicated digital microprocessor 26. This processor together with personality data, contained in a personality PROM 27, unique to the display unit's specific CRT, adapts the displayed symbology or informtaion to the pilot at the contrast or brightness level he has manualy selected, and thereafter automatically adjusts the individual color cathode drives to maintain the originally commanded color over the entire ambient brightness conditions. The microprocessor 26 may be any one of a number of readily available microprocessors and in the present embodiment may be one of the M6800 series, such as an M6802 available from Motorola, Inc., Schaumburg, Ill., while the PROM 27 may be any conventional programmable or alterable read only memory such as a voltage programmable infrared alterable PROM. As stated the personality PROM 27 contains parameters unique to a specific CRT and hence a particular CRT assembly is designed to include its own PROM as an integral part thereof whereby if a display unit CRT assembly requires replacement no calibration of the new CRT assembly is required. Although the personality PROM may contain a number of parameters dependent upon the peculiar characteristics of the CRT to which it is tailored, in terms of the present invention, and as will be described below, it also includes the tube's output brightness versus cathode drive voltage characteristic for each color phosphor and color intensity factors for each primary color as well as the reflectance characteristics peculiar to the tube's particular faceplate, filter, antireflectance coating, etc. The display unit controller 25 also includes a scratch pad random access memory 28 for use by the microprocessor 26 in performing the computations to be discussed hereinbelow.

As is known to those skilled in the CRT art, each CRT has characteristics peculiar to itself. One of these is its gamma ($\gamma$) characteristic; that is, the brightness, in foot lamberts, of the phosphor emission for a given voltage applied to the CRT cathode. In shadow-mask type CRT's there are three independent gammas, one for each of the three primary color phosphors. Of course, the brightness output of the CRT used in determining its gamma characteristic must include any effects of faceplate filters such as the contrast enhancement filters above referred to. Also, in order to maintain a given color hue or chromaticity over the entire brightness range, the relative intensity of each primary color component must be varied in accordance with its particular gamma characteristic. In addition, it is desirable to vary each color hue component in accordance with the variances in color perception by the human eye.

Figure 3A:
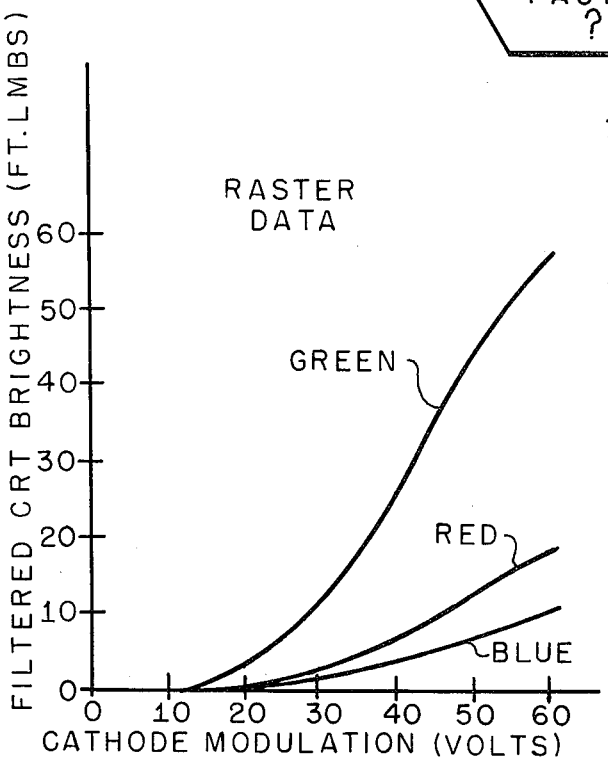
FIGS. 3*a* and 3*b* are brightness output vs. cathode drive voltage curves for both raster and stroke written symbology of a typical shadow-mask type color CRT display.
Figure 3B:
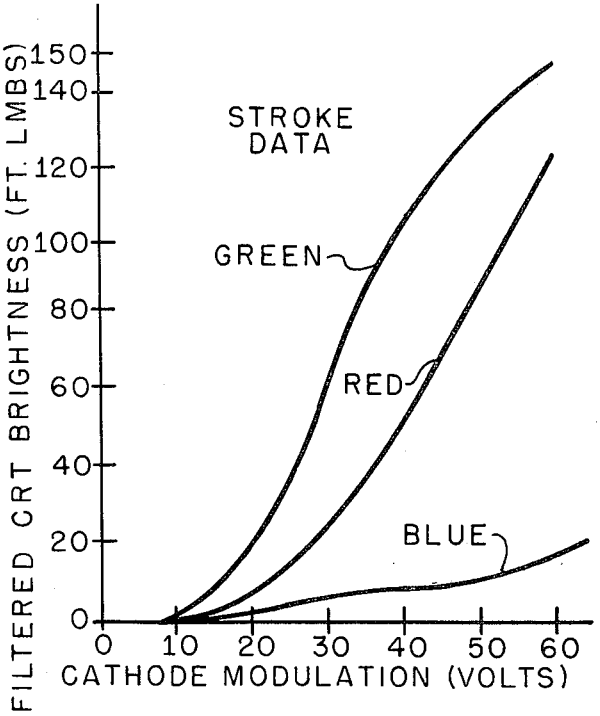

Thus, each CRT of the display system is characterized by measuring the brightness output, including any filters, of each of its primary color phosphors for a plurality of cathode voltages applied to each color's cathode and if the symbology is to be stroke and raster written, separate measurements must be made for each writing technique. Conventional optical equipment may be used for this purpose and on a production basis the curve plotting may be automatic. The result of such measurements of a typical CRT is illustrated in FIGS. 3*a* and 3*b*. Note that stroke written symbology is much brighter than raster written symbology for the same cathode voltages. This is due to the much slower beam deflection rates required to draw stroke written symbols than that required to draw raster written symbols.

The brightness versus cathode drive voltage curves are analyzed and a number of points on each curve are selected, each of which represent the specific drive voltage required to produce a corresponding symbol color and brightness. Since the human eye responds logarithmically, the selected points should be distributed logarthmically; that is, the points along the brightness axis should be closer together at low brightness and spread out at higher brightnesses in exponential fashion. The number of measured values necessary to accurately establish the curve depends on interpolating skill. In one embodiment of the invention, as many as eighty points on each of the six curves were selected. However, since these curves have no sharp discontinuities and are generally predictable, the number of points selected may be relatively few, for example as few as four, all in accordance with the desired resolution and size of the digital memory. Obviously, if a particular application requires only stroke or only raster written symbology, only those curves are used.

After all curve points have been established, the corresponding cathode drive voltages for all three primary color components for all commandable colors for both stroke and raster writing modes are assembled in six color/gain tables and these tables are conventionally stored in digitalized format in a suitable digital programmable memory, such as PROM 27, each memory location corresponding to a desired brightness and containing the particular cathode voltage drive required to produce the desired brightness. In one embodiment each table comprised a 128×8 memory thereby providing 128 stored voltages and allowing 255 voltages using a single linear interpolating scheme for producing the required color component of the seven colors over the entire brightness range. Each memory is addressed in accordance with the value of the reference brightness in foot lamberts computed by the microprocessor in accordance with the computer program represented by the flow chart of FIGS. *2a* and *2b* to be described below. Thus a conventional smoothing program subroutine (not shown) may be provided for effectively performing an interpolation between successive stored points in the curves to reduce the number of actual measured points required.

It will be appreciated from the foregoing that the gamma characteristics of the CRT may be determined and the piecewise mathematical characteristics of the curves determined so as to provide an efficacious interpolation of points along the curves. The points are selected and the interpolation performed in accordance with the determined shape of the curve so as to provide the entries in the six color/gain tabes stored in the PROM 27. In the embodiment described, a relatively small number of points are taken from the gamma characteristic curves and the piecewise interpolation performed in accordance with the shapes of the curves to provide the 128 entires in each of the tables. Thereafter a simple linear interpolation between the stored points is utilized to provide the resolution of 255 cathode drive voltages across the ambient brightness range of the system.

In accordance with the present invention, the color brightness/contrast is automatically maintained at the level manually selected by the pilot on the display system controlled over the very wide range of ambient light conditions experienced in the cockpit of an aircraft. The microprocessor is programmed to compute the cathode drive voltages required by the specific characteristics of the CRT for each of the three cathodes dependent upon the pilot selected brightness as set by selector 30, and in accordance with one or more ambient light sensors 31 in the cockpit, preferably closely adjacent to or built into the bezel of the display unit. Alternatively, a further light sensor, 32 preferably mounted on the glare shield and subjected to the light intensity forward of the aircraft, may be employed to further boost the tube brightness in accordance therewith. The purpose of this remote light sensor is to compensate for the relatively slow response of the pilot's eyes in adapting to the interior cockpit lighting after looking out of the cockpit front windshield. In applications of the invention involving two companion and usually adjacent display units, such as a primary flight display unit and a navigation display unit, each having its own ambient light sensor, it is desirable that the ambient light sensed by each be compared, by conventional means not shown, and the greatest of these inputs be used to adjust the brightness of both display units so that the brightness of both units is always the same.

Thus, the pilot selected brightness signal generated as an analog voltage by selector 30, the cockpit light sensor signal generated as an analog voltage by, for example, an optical diode associated with sensor 31 and the glare shield sensor signal generated as an analog signal by an optic diode associated with sensor 32 are all supplied to a conventional analog selector or multiplexer 33. Each of these signals is called up by the microprocessor brightness control program through conventional latches 34 responsive to program decoder 35 as they are required. Each analog input signal is converted to digital signal format by A/D converter 36 which signal is supplied to microprocessor data bus 37, all using conventional and well known digital techniques.

As stated above, the display controller 25 with its dedicated microprocessor 26 manages the video processing circuitry and guarantees precise chromaticity for all colors throughout the entire range of display unit brightness levels. also, as stated above, the symbol generator sends to the line receivers 15 a four bit command word comprising three bits of color and one bit of intensity information to thereby provide a command for any one of seven distinct colors in addition to black (blanked video) plus two levels of intensity for each color. The command word is used to address the video RAMS 16, 17 and 18 via video address bus 19 either singly or in combinations of two or three to produce all seven distinct colors at either of the two desired levels of intensity. In one raster/stroke embodiment of the invention, each video RAM comprises 128 memory bits, organized in a 16×8 RAM, each of these RAMS being time shared between raster and stroke writing modes in accordance with the symbol generator sync signal operating through the display controller 25. Each of of the video RAMS is loaded by the controller 25 with digital data representing all the cathode modulation voltages required to produce all seven colors, each at the two intensities commanded by the symbol generator, at intensity levels dependent upon the ambient light conditions existing in the cockpit. The RAM address bus 19 selects the three voltages required to produce the color and intensity commanded by the symbol generator. The display controller 25 is programmed so as to monitor the pilot's brightness selector and track the cockpit ambient light sensors and to automatically update the contents of the video RAMS to assure that each of the cathode drive voltages are such as to maintain precise chromaticity of the commanded colors over the entire range of display brightness levels.

Figure 2B:
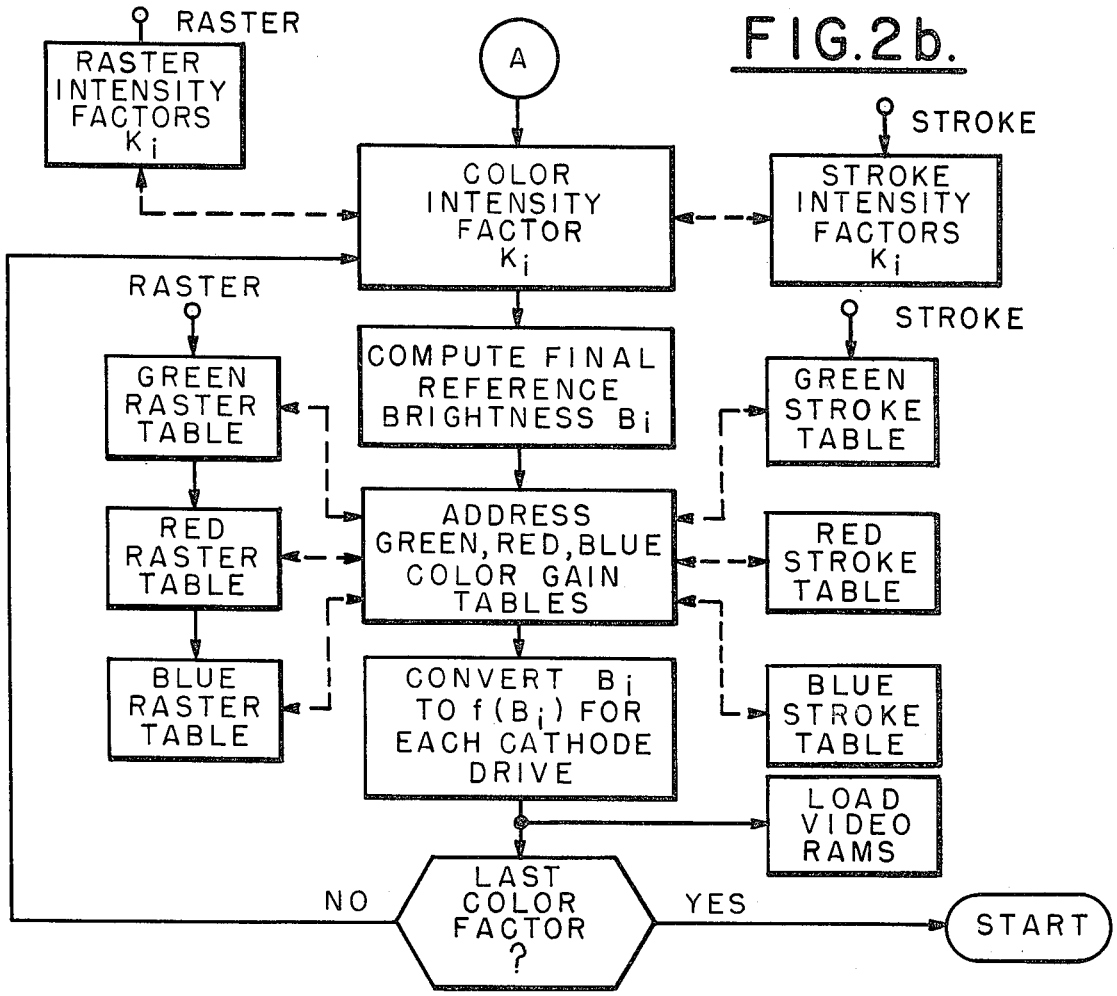

The microprocessor program or brightness computation flow chart for accomplishing this is illustrated in FIGS. 2*a* and 2*b*. In general, the program governs the computations performed by the processor for varying the contents of the video RAMS in accordance with the existing and changing ambient light conditions in the cockpit. The program which may be stored in PROM 27 or in a separate program ROM runs on its own clock and is independent of the symbol generator timing. Its execution time is very short, i.e., on the order of two milliseconds, compared to the display refresh rate which may be on the order of eighty frames per second. The symbol generator sync signals (in a raster/stroke system this may be a raster/stroke command) is used to produce through control 40 an update signal or program interrupt signal which freezes the then addressed brightness (cathode drive voltage) data in the PROM gain tables and through conventional latches transfers this existing brightness data to the video RAMS thereby updating the RAMS to provide the cathode voltages required for the existing cockpit brightness conditions. After video updating, the update is reset and the microprocessor 26 continues to execute its program. Thus it is appreciated that the sync signals from the symbol generator via the update signal from the control 40 causes the controller 25 to provide video information to the video RAMS with respect to generating the current frame on the CRT 10.

As explained above, the human eye responds to brightness in a logarithmic fashion. At dim ambient light levels the eye can resolve smaller brightness changes than at high ambient light levels. Thus in the system of the present invention greater brightness resolution is utilized at low ambient brightness levels that at high levels. This logarithmic response of the human eye results in implementation simplifications in the herein described embodiments of the invention. The color/-gain tables stored in the PROM 27 are stored as a logarithmic distribution of values and the intensity factor tables to be fully described hereinbelow storing the intensity factors $K_i$, are stored as log $K_i$. The input signals from light sensors and potentiometers are converted into logarithmic values by conventional table look-up techniques. Thereafter all of the multiplications required in deriving the cathode drive voltages are performed by the addition of logarithmic values and divisions by utilizing subtraction. Since multiplication and division are generally time consuming operations requiring relatively complex hardware implementations, the logarithmic basis of the system results in faster and simpler apparatus. Thus in the flow charts of FIGS. 2*a* and 2*b* and in the equivalent hardware embodiment of FIG. 4, the multiplications and divisions as well as the squaring operations illustrated are performed by additions and subtractions of logarithms as will be explained in further detail.

Referring to FIGS. 2*a* and 2*b*, the program flow charge is illustrated and is generally self-explanatory. The program starts with the sampling of the cockpit light sensor voltage A, A/D converted and latched onto the processor data bus. This signal is converted to a logarithmic value (log A) in terms of foot candles using well known table "look-up" techniques. Since the light falling on the sensor also falls on the display tube face, the latter's reflectance characteristic R should be included in the display brightness calculations. The value of R is a constant for a particular CRT and faceplate including any filter and is stored as a constant as a logarithmic value in the PROM 27. The program then calls for a multiplication of these terms through adding their logs, the resultant being the background brightness RA, i.e., the internal cockpit ambient light intensity in foot candles. The nominal brightness ratio $B_o$ is then calculated through an expression for the contrast ratio, $CR=(B_o+RA)/RA$. The desired contrast ratio CR is determined by the setting of the pilot's brightness controller 30. In thoser embodiments of the invention which include the pilot's separate control of the brightness of raster written symbology and stroke written symbology, the brightness controller 30 comprises separate knob-positioned potentioneters. The program recognizes whether stroke or raster symbology is being commanded through the sync signal and which potentiometer has been activated and accordingly sets a "stroke flag" which determines which of the brightness tables derived from curves of FIGS. 3*a* and 3*b* will be addressed when called for by the program. The program calls up the potentiometer signal V, converts it to log V and multiplies (adds) by a constant factor $K_2$ stored as a log value in memory, the constant $K_2$ scaling the product to read directly in foot lamberts. At low ambient light levels, the contrast ratio CR potentially is very large while at high ambients it is low. Therefore, under low ambient conditions the display brightness should be based on absolute brightness and at higher ambients it should be based on contrast ratio. To compute this nominal brightness the potentiometer signal is "squared" (log V is added to log V) and multiplied by a constant $K_1$ to convert the result to foot lamberts (log $K_1$ added to 2 log V). It will be appreciated that functions of the pilot's brightness control other than squaring may be utilized in accordance with desired results. The program compares the two values of nominal brightness and selects the maximum, which value is used in the remainder of the programmed computations. Thus, it will be noted that at high ambients the brightness of the displayed symbology is controlled primarily in accordance with the ambient light sensor signal as modified by CRT reflectance characteristics and a desired contrast ratio, while at lower ambients, the brightness of the displayed symbology is controlled primarily in accordance with a nominal brightness set by the pilot.

As stated earlier, a remote light sensor 32 preferably mounted on the cockpit glare shield looks out the front windshield and hence provides a measure of the sky brightness to which the pilot's eyes are subjected when he is looking outside the cockpit. Since the iris of the human eye is quite slow in responding to abrupt changes in light intensities, such as when the pilot is looking out the windshield and then looks at his instrument display, the program has been provided with means for compensating for this physiological characteristic by calculating a brightness boost factor M. This compensation is most valuable when the outside brightness is substantially greater than the inside brightness. Because the internal light sensor adjusts the display brightness for internal light conditions, the display brightness may not be sufficient for the pilot to immediately respond thereto and therefore the display brightness level should be boosted. The program calls up the remote light sensor signal $A_R$, converts $A_R$ to log $A_R$, and determines the ratio thereof with the nominal (internal) brightness $B_o$ by subtraction of logs. If the value of this ratio is less than some predetermined value, dependent at least in part upon the eye's physiology, a first relatively low value, substantially constant boost factor is provided (at the lower exterior brightness the boost factor may remain constant); if greater than predetermined $A_R/B_o$ value, a second boost factor is provided which varies, i.e., increases, substantially linearly from the predetermined constant value to a predetermined maximum value in accordance with increases in exterior light conditions. The boost factor M is converted to log M. The nominal brightness $B_o$ and boost factor M are multiplied, their logs added, to provide the basic reference brightness $B_{REF}$ for the display system.

After the reference brightness for the existing ambient cockpit lighting has been calculated, the program determines whether or not the stroke flag has been set. If not, i.e., raster symbology is being commanded and the raster intensity factor tables and the raster color/-gain tables for the three primary colors are utilized in the ensuing computations. If the stroke flag has been set, the stroke tables are utilized.

Since the brightness of a display symbol on the CRT screen is a function of electron beam spot size which in turn is a function of the cathode drive, it is usually necessary to adjust the electron beam focus in accordance with the reference brightness. The reference brightness signal is therefore used to calculate a reference focus signal, such calculation being based on the particular CRT's focus polynomial coefficients which are stored in the tube's personality PROM. The resulting reference focus signal is used to address a focus voltage table, also stored in PROM to provide predetermined focus voltages, which effectively defocus the electron beam for substantially eliminating any moiré and roping effects produced by interaction between the beam width or spot size and the spacing of the shadow-mask apertures, all as taught in Applicants' assignee's copending application Ser. No. 306,452, filed 9-28-81 entitled "Focus Control Apparatus for Shadow-Mask Type Color CRT's".

As stated above, in the embodiment of the present invention being discussed, raster and stroke written symbols in seven different but predetermined colors are provided, in addition to black. Each color of course is composed of one, two or three components of the primary colors green, red or blue and each of the colors being predetermined by the relative intensities of each of its primary components. Also, these relative intensities take into consideration the variances in perception of the human eye in perceiving different colors. Since these relative intensities vary from tube to tube, their respective values $K_i$ are stored as constants in the personality PROM. Thus, the program next addresses the PROM for the required constants (stored as logs) which are multiplied by the reference brightness $B_{REF}$ factor to provide the individual brightness levels $B_i$ for each green, red or blue components of each of the commanded colors. These values of $B_i$ are therefore used to address the color gain tables described above.

It will be recalled that each gain table includes data representing discrete cathode drive voltages required to produce the required color component of each of the seven colors over the entire ambient brightness range. These voltages are represented by corresponding log values. Now that the ambient brightness level $B_i$ for each color component has been computed, this value of $B_i$ is used to address the color gain tables to derive signals representing the cathode drive voltages required to produce each of the color components at the intensity level compatible with the existing ambient brightness. These log signals are conventionally converted to digital signals representing the actual required cathode voltages. The program finally loads these voltages into the video RAMS which are addressed by the color command of the symbol generator as above described.

Specifically, when the "stroke flag" of FIG. 2*a* is set for either stroke or raster, appropriate signals are set which will establish a program flow utilizing either the stroke tables or the raster tables in accordance with the setting of the flag. FIG. 2*b* illustrates the raster intensity factor table as well as the green, red and blue raster color/gain tables which are utilized when the "stroke flag" indicates raster. Additionally, FIG. 2*b* illustrates the stroke intensity factor table as well as the green, red and blue stroke color/gain tables utilized when the "stroke flag" indicates the stroke mode. Each of the raster and stroke intensity factor tables is, in fact, comprised of three tables, one for each of the primary colors. Thus, each of the intensity factor tables comprises a green intensity factor table, a red intensity factor table and a blue intensity factor table. In the present embodiment of the invention where a four bit word from the symbol generator selects one of 16 possible colors (or specifically as in the present embodiment eight colors, each with two intensities), each primary color intensity factor table stores 16 $K_i$ values, one for each of the selectable colors. The $K_i$ values are, in fact, stored as logarithmic values for the reasons discussed above. Thus for each of the 16 colors that the system of the present invention is capable of displaying, there are three $K_i$ values stored in the respective green, red and blue intensity factor tables for each of the raster and stroke modes. These three $K_i$ values for each color are in such proportion with respect to each other that the desired color is created from the three primary colors. Additionally, the $K_i$'s are established whereby different colors commanded by the symbol generator at the same commanded intensity appear equally as bright for the same reference brightness $B_{REF}$. In this manner the $K_i$'s may be chosen to compensate for the variances in apparent brightness perceived by the human eye for different colors at the same actual brightness (luminance).

As discussed above, the PROM 27 includes the green, red and blue color gain tables for each of the raster and stroke modes, the appropriate set of tables being utilized in accordance with the setting of the "stroke flag". In operation during each iteration the program calls up each of the 16 intensity factors $K_i$ for each of the primary colors multiplying each $K_i$ by the reference brightness $B_{REF}$ to provide a final reference brightness $B_i$. Each of these 16 $B_i$'s computed in turn for each of the primary colors is utilized to address the associated color/gain table for the primary color to obtain the cathode drive $f(B_i)$ corresponding thereto. Each of these 16 cathode drive signals for each of the primary colors are stored in the associated video RAM for the primary color. Each of the 16 values for green, red and blue are computed, each iteration in accordance with the reference brightness $B_{REF}$ provided as illustrated in FIG. 2*a*. Thus during each iteration the appropriate green, red and blue cathode drives for all of the 16 colors that may be commanded by the symbol generator are stored in the video RAMs for appropriately energizing the three color cathodes.

The above described embodiment of the invention was explained in terms of a microprocessor with the control program described above with respect to flow charts of FIGS. 2a and 2b. The computer architecture illustrated in FIG. 1 is conventional and well known to those skilled in the art. Alternatively, the described functions may be implemented utilizing dedicated digital logic or analog circuitry.

Figure 4:
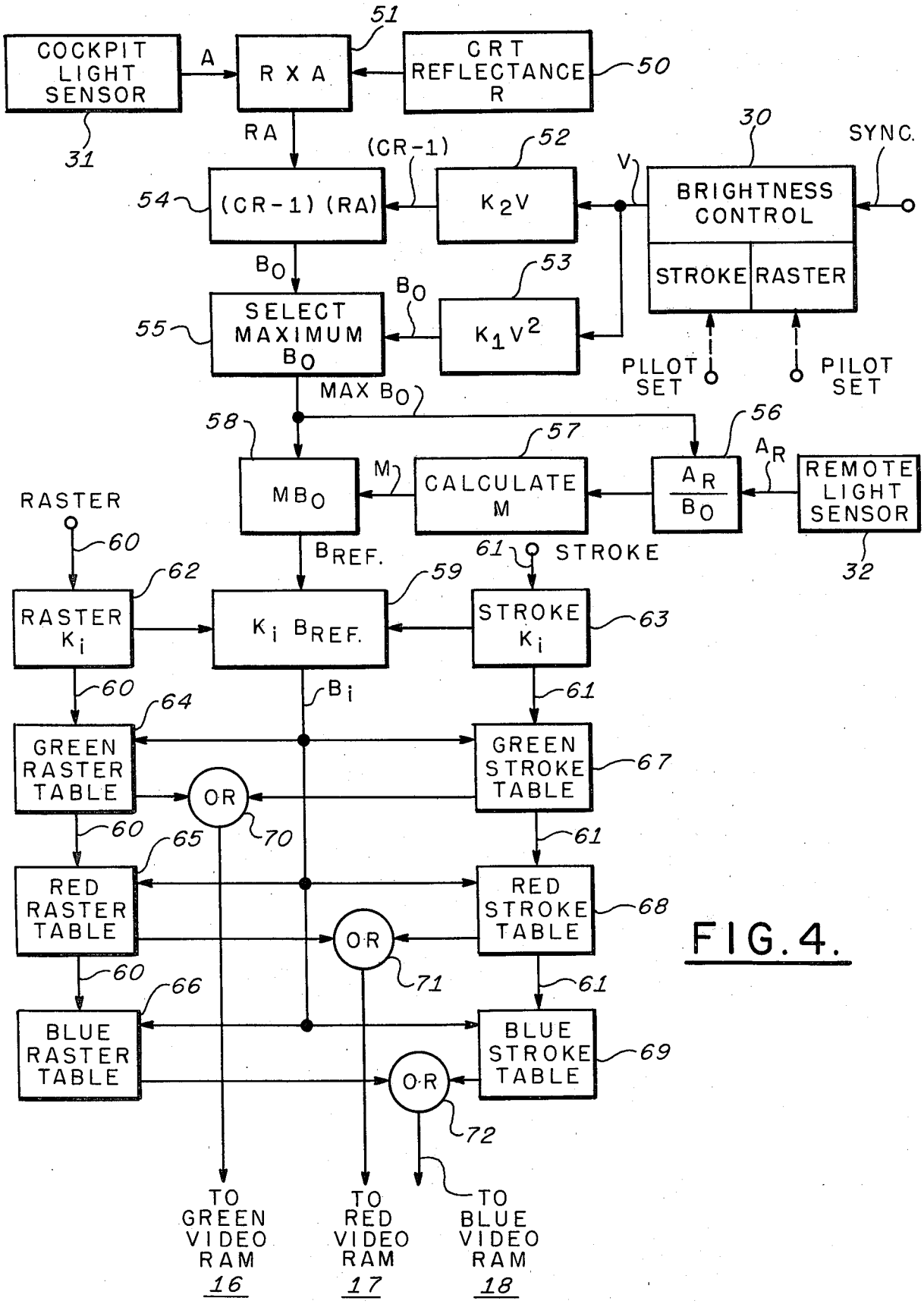
FIG. 4 is a schematic block diagram of an alternative hardware embodiment of the present invention.

Referring now to FIG. 4 in which like reference numerals indicate like components with respect to FIG. 1, a hardware embodiment of the present invention is illustrated, the blocks thereof being implemented by any convenient circuitry. It will be appreciated in a manner similar to that described above with respect to FIGS. 2a and 2b that, preferably, input signals are converted to logarithmic values by, for example, conventional table look-up techniques, stored values are stored in logarithmic fashion and multiplication and division are performed by the addition and subtraction of logarithmic values respectively. The ambient light intensity A from the cockpit light sensors 31 and the CRT reflectance value R stored at 50 are combined in block 51 to provide the value RA. The pilot set brightness control potentiometers 30 provide the output V which is the value from the stroke potentiometer or the raster potentiometer as selected by the SYNC signal. The signal V is multiplied by the constant $K_2$ in the block 52 to form the quantity (CR-1). The nominal brightness $B_o$ is provided in the block 53 by forming $K_1V^2$. The contrast ratio signal from the block 52 is applied to a block 54 to be combined with the signal RA to form the nominal brightness $B_o$ based on contrast ratio. The values of $B_o$ from the blocks 53 and 54 are applied to a maximum value selector 55 which selects the maximum $B_o$. The output of the maximum value selector 55 is applied as an input to a block 56 which is also responsive to the output of the remote light sensor 32. The block 56 provides the brightness ratio $A_R/B_o$ to a block 57 wherein the boost factor M is computed in the manner described above. The maximum nominal brightness $B_o$ and the boost factor M are combined in a block 58 to provide the reference brightness $B_{REF}$.

The reference brightness $B_{REF}$ is applied to a block 59 wherein it is combined with a sequence of $K_i$ intensity factors to provide a sequence of final reference brightness values $B_i$. In accordance with the operative mode of the system either a raster signal is applied to the leads 60 to enable the raster tables or a stroke signal is applied to the leads 61 to enable the stroke tables. The apparatus includes green, red and blue raster intensity factor tables 62 as well as green, red and blue stroke intensity factor tables 63. These tables are configured in the manner described above with respect to FIGS. 2a and 2b. The apparatus also includes green, red and blue raster color/gain tables 64, 65, and 66 respectively as well as green, red and blue stroke color/gain tables 67, 68 and 69 respectively. When raster data is to be written the signal on the lead 60 enables the raster tables 62, 64, 65 and 66. When stroke data is to be written, the signal on the lead 61 enables the stroke tables 63, 67, 68 and 69.

When, for example, raster data is to be written, each green, red and blue $K_i$ factor from the block 62 is applied to the block 59 wherein the corresponding $B_i$ value is generated and routed to the appropriate one of the primary color tables 64, 65 and 66. Thus the 16 $B_i$ values generated from the 16 green $K_i$ values address the green color/gain table 64 to provide the corresponding cathode drive voltages. The red and blue cathode voltages for raster are generated in a similar manner. Similarly when stroke is called for, the green, red and blue cathode voltages are provided by activating tables 63, 67, 68 and 69. The outputs of the green raster table 64 and the green stroke table 67 are provided through an OR gate 70 to the green video RAM 16. In a similar manner, OR gates 71 and 72 provide the video data from the red and blue color/gain tables to the respective red and blue video RAMS.

Although the above described apparatus was explained in terms of sequential generation of the cathode drive voltages for the three primary colors, it is appreciated that parallel circuits may be utilized to provide the green, red, and blue components for each of the 16 selected colors simultaneously.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. Color and brightness tracking control apparatus for a color cathode ray tube display instrument system subjected to viewing under a wide range of ambient light conditions comprising (a) a cathode ray tube having a display screen for emitting images in a plurality of different colors dependent upon the independent and variable energization of cathode means for producing at least two independent primary colors the relative brightnesses of which determine said plurality of colors, (b) video command means for commanding at least one image to be displayed in at least one predetermined color comprised of components of said two primary colors at the required relative brightness levels, (c) ambient light sensor means for providing a signal corresponding to the range between the extremes of ambient light conditions existing in the vicinity of said display instrument, (d) computer means including (i) memory means containing data representing the independent cathode energizations required to produce each of said primary color component relative brightnesses over said range of ambient light conditions, and (ii) processor means responsive at least in part to said light sensor means for continuously computing a reference display brightness and for deriving from said memory means cathode energization data required to produce said two primary color component relative brightnesses at the existing ambient light conditions, and (e) means responsive to said video command means and said derived cathode energization data for energizing said cathode means to thereby produce said predetermined color image at the existing ambient light conditions.

2. The apparatus of claim 1 in which said computer means comprises digital computer means.

3. The apparatus as set forth in claim 1 further including (a) manual brightness control means for supplying a signal corresponding to a desired display brightness, and (b) means for supplying said desired brightness signal to said processor means for computing said reference brightness as a function of both said ambient light sensor signal and said manually controlled brightness signal.

4. The apparatus as set forth in claim 3 wherein said computed reference display brightness is based primarily on said light sensor signal for relatively high ambient light conditions and is based primarily on said manual control brightness signal for relatively low ambient light conditions.

5. The apparatus as set forth in claim 1 wherein said display system is installed in an aircraft cockpit, said system further comprising remote light sensor means responsive to the lighting conditions exteriorly of said aircraft cockpit and for supplying a signal in accordance therewith, and means for supplying said last mentioned signal to said processor means for computing a reference brightness boost factor as a function of said ambient light sensor signal and said remote light sensor signal.

6. The apparatus as set forth in claim 1 wherein said video command means commands a predetermined color for each of at least two images, one stroke written and one raster written, (a) wherein said memory means further includes data representing the cathode energization required to produce each of said primary color component brightnesses for each image over said range of ambient light conditions, (b) wherein said processor means further includes means responsive at least in part to said light sensor means for continuously and independently computing a reference display brightness for each of said images and for deriving from said memory means cathode energization data required to produce said primary color component brightnesses for each of said images at the existing ambient light conditions, and (c) wherein said video command responsive means further includes means for deriving the cathode energization data for energizing said cathode means to thereby produce said predetermined colors for each of said images at the existing ambient light conditions.

7. The apparatus as set forth in claim 1 wherein said cathode energization means comprises (a) further memory means responsive to said processor means for receiving from said processor means said derived cathode energization data required to produce said primary color component brightnesses at said reference ambient brightness, and (b) wherein said video command means addresses said further memory means for extracting said relative cathode energizations.

8. The apparatus as set forth in claim 7 wherein said first mentioned memory means comprises a programmable read only memory and wherein said further memory means comprises a random access memory means.

9. The apparatus as set forth in claim 1 wherein said memory means contains (i) intensity factors for each of said plurality of colors, the intensity factors for a color being associated respectively with said independent primary colors and proportioned with respect to each other in accordance with the relative brightnesses of said primary colors to produce said color, and (ii) brightness versus cathode energization data for each said primary color in accordance with the gamma characteristics of said cathode ray tube, and wherein said processor means is responsive to said intensity factors and to said reference display brightness for deriving therefrom reference brightness addresses and for addressing said gamma characteristic data therewith for providing said cathode energization data.

10. The apparatus as set forth in claim 2 wherein said digital computer means includes means for converting said signal from said light sensor means into an equivalent logarithmic signal, said data contained in said memory means is stored in logarithmic format, and said processor means includes means for computing said reference display brightness and for deriving said cathode energization data by linear combinations of logarithmic values.

11. Color and brightness tracking control apparatus for a color cathode ray tube display instrument system subjected to viewing under a wide range of ambient light conditions comprising (a) a cathode ray tube having a display screen for emitting images in a plurality of different colors dependent upon the individual and variable energization of cathode means for producing at least three individual primary colors the relative brightnesses of which determine said plurality of colors, (b) video command means for commanding a predetermined plurality of colors in which a plurality of images are to be displayed, each of said colors comprising a plurality of predetermined components of said primary colors at predetermined relative brightness levels, (c) ambient light sensor means for providing a signal which varies in accordance with the extremes of ambient light intensities existing in the vicinity of said display instrument, (d) digital computer means including (i) memory means containing data representing the individual cathode energization required to produce each of said primary color component relative brightness levels required to produce each of said predetermined plurality of colors over said range of ambient light intensity conditions, and (ii) processor means responsive at least in part to said light sensor means for continuously computing a reference display brightness dependent upon the existing ambient light intensity conditions and for deriving from said memory means the cathode energization data required to produce each of said predetermined plurality of colors at the existing ambient light intensity conditions, and (e) means responsive to said video command means and said derived cathode energization data for energizing said cathode means to thereby produce said predetermined plurality of color images at the existing ambient light intensity conditions.

12. A method of operating a color cathode ray tube (CRT) display instrument, which is viewable under a wide range of ambient light conditions, with the aid of a digital computer, comprising (a) providing said computer with a stored data base peculiar to said CRT display including at least a plurality of cathode drive excitations required to produce a corresponding plurality of brightnesses of each of the CRT's primary color emissions, (b) constantly measuring the ambient light conditions in the vicinity of said display, (c) constantly providing the computer with said ambient light measure, (d) repetitively calculating in the computer at a rate substantially greater than the refresh rate of said CRT display, a reference display brightness compatible with said ambient light conditions, and (e) repetitively extracting from said data base at said calculation rate a cathode drive excitation corresponding to the brightness of each color component emission for the existing ambient light conditions.

* * * * *